US007018278B2

(12) United States Patent
Wirz

(10) Patent No.: US 7,018,278 B2
(45) Date of Patent: Mar. 28, 2006

(54) DEVICE FOR THE FIXTURE OF A TOOL HOLDER

(75) Inventor: Walter Wirz, Pfaffikon (CH)

(73) Assignee: Reishauer AG, Wallisellen (CH)

( * ) Notice: Subject to any disclaimer, the term of this patent is extended or adjusted under 35 U.S.C. 154(b) by 0 days.

(21) Appl. No.: 11/052,037

(22) Filed: Feb. 8, 2005

(65) Prior Publication Data

US 2005/0208886 A1 Sep. 22, 2005

(30) Foreign Application Priority Data

Mar. 16, 2004 (DE) ..... 10 2004 013 014

(51) Int. Cl.
*B24B 41/00* (2006.01)

(52) U.S. Cl. ..... 451/342; 451/359; 451/360

(58) Field of Classification Search ..... 451/340, 451/342, 344, 353, 359, 360
See application file for complete search history.

(56) References Cited

U.S. PATENT DOCUMENTS

| | | | | |
|---|---|---|---|---|
| 2,675,653 A | | 4/1954 | Bryant | |
| 4,809,465 A | | 3/1989 | Mushardt et al. | |
| 5,545,078 A | * | 8/1996 | Schulz et al. | 451/342 |
| 6,042,461 A | * | 3/2000 | Pearson | 451/359 |

FOREIGN PATENT DOCUMENTS

| | | |
|---|---|---|
| DE | 36 42 111 A1 | 6/1988 |
| DE | 100 02 263 A1 | 7/2001 |

* cited by examiner

*Primary Examiner*—Jacob K. Ackun, Jr.
(74) *Attorney, Agent, or Firm*—Browdy and Neimark, PLLC

(57) ABSTRACT

A detachable fixture of a rotary machining tool (3) on the tool spindle (2) of a machine tool and in particular of a grinding wheel flange (4) on the spindle nose (1) of a grinding spindle (2) is provided with two clamping rings. By means of the Cardanic located clamping rings (10, 13), the clamping force F generated by turning a clamping screw (7) is distributed uniformly on the spindle flange (6). The tool fixture according to the invention permits even large and heavy driven tools with high demands on stiffness and repeatability with respect to radial and axial runout and quality of balance to be changed with little time expenditure.

12 Claims, 4 Drawing Sheets

DEVICE FOR THE FIXTURE OF A TOOL HOLDER

FIELD OF THE INVENTION

The present invention concerns a device for the fixture of a tool holder for a rotary machining tool. The invention applies particularly to a grinding wheel flange and its fixture to the tool spindle of a grinding machine.

BACKGROUND OF THE INVENTION

For the economical use of modern production machines, their high acquisition costs demand that not only the machining time of a workpiece is restricted to a minimum, but also the downtimes of the machine. This also applies to the time for machine change-over from one workpiece to another workpiece to be machined, and means that as far as the procedure includes a tool change this must be performable with minimum time expenditure without loss in fixture accuracy.

With small tools, this demand can often be fulfilled without technical problems. It is sufficient to loosen or tighten a single screw or to trigger a single automatic clamping action, in order to unclamp the tool and then to clamp the new exchanged tool to the tool spindle, retaining the same high radial and axial runout accuracy. Such fixtures for rotary machining tools are well known in numerous engineering standards. The time expenditure for a tool change is short.

In the case of heavy and large tools, however, on account of the weight and the demands on rigidity and on repeatability with respect to the quality of radial runout, axial runout and balance of the connection between tool and tool spindle, it is often not possible to manipulate the fixture of the tool on the tool spindle by means of loosening and tightening a single screw. Such tools include, for example, the grinding worms of grinding machines for the grinding of gears.

DE 100 32 073 shows a typical example for the fixture of a grinding worm on the spindle nose of the grinding spindle of a tooth flank grinding machine by means of a taper spigot and flange screws. In order to achieve the high quality of radial and axial runout which must be demanded for reasons of production quality, and to avoid impermissible out-of-balance on the grinding spindle, a tool change requires six screws arranged symmetrically around the periphery of the grinding spindle flange to be unscrewed and, after the tool change, to be tightened uniformly in alternating sequence. This process takes a comparatively large amount of time. For the reduction of change-over effort, therefore, practical considerations demand solutions by which the time required as common to practice for the changing of a grinding worm is substantially decreased without quality loss.

SUMMARY OF THE INVENTION

It is an object of the present invention to provide a tool fixture for grinding worms and other rotating tools with high stiffness and accuracy demands, with which the short tool change-over times customary for small tools are not exceeded.

This object is attained by a device for the fixture of a tool holder of a rotating machining tool having the features stated in claim 1.

According to the invention, the device for the attachment of a tool holder of a rotary machining tool to the spindle nose of the tool spindle of a machine tool incorporates a flange sleeve, an axially movable and inclinable first clamping ring, a second clamping ring acting as force distributor, and swivel-clear bearer segments, where the first and the second clamping rings are located between the fixture flange and the flange sleeve, and the first clamping ring is tilt located on the second clamping ring by means of a clamping screw, and where the bearer segments support the flange sleeve axially against the spindle nose.

Thanks to the Cardan style connection between the clamping rings, the device according to the invention permits the release of the tool and the clamping of a new exchanged tool by means of a single clamping screw, even in the case of large and heavy tools with extreme demands on rigidity and repeatability with respect to radial and axial runout and quality of balance. The change-over itself requires a minimum of time.

BRIEF DESCRIPTION OF THE DRAWINGS

In the following the invention is explained in detail by way of a preferred embodiment which is illustrated in the annexed drawings. The drawings depict.

DETAILED DESCRIPTION OF A PREFERRED EMBODIMENT

The invention is described in the following with reference to the attachment of a grinding wheel flange to a grinding spindle. The grinding wheel flange here takes the form of a tool holder which is detachably connected to a rotary machining tool, i.e. to a grinding wheel or a grinding worm. It is however also possible to attach other kinds of rotary machining tools in the same manner. In particular the tool holder can also be an integral component part of the machining tool.

Figure 1:
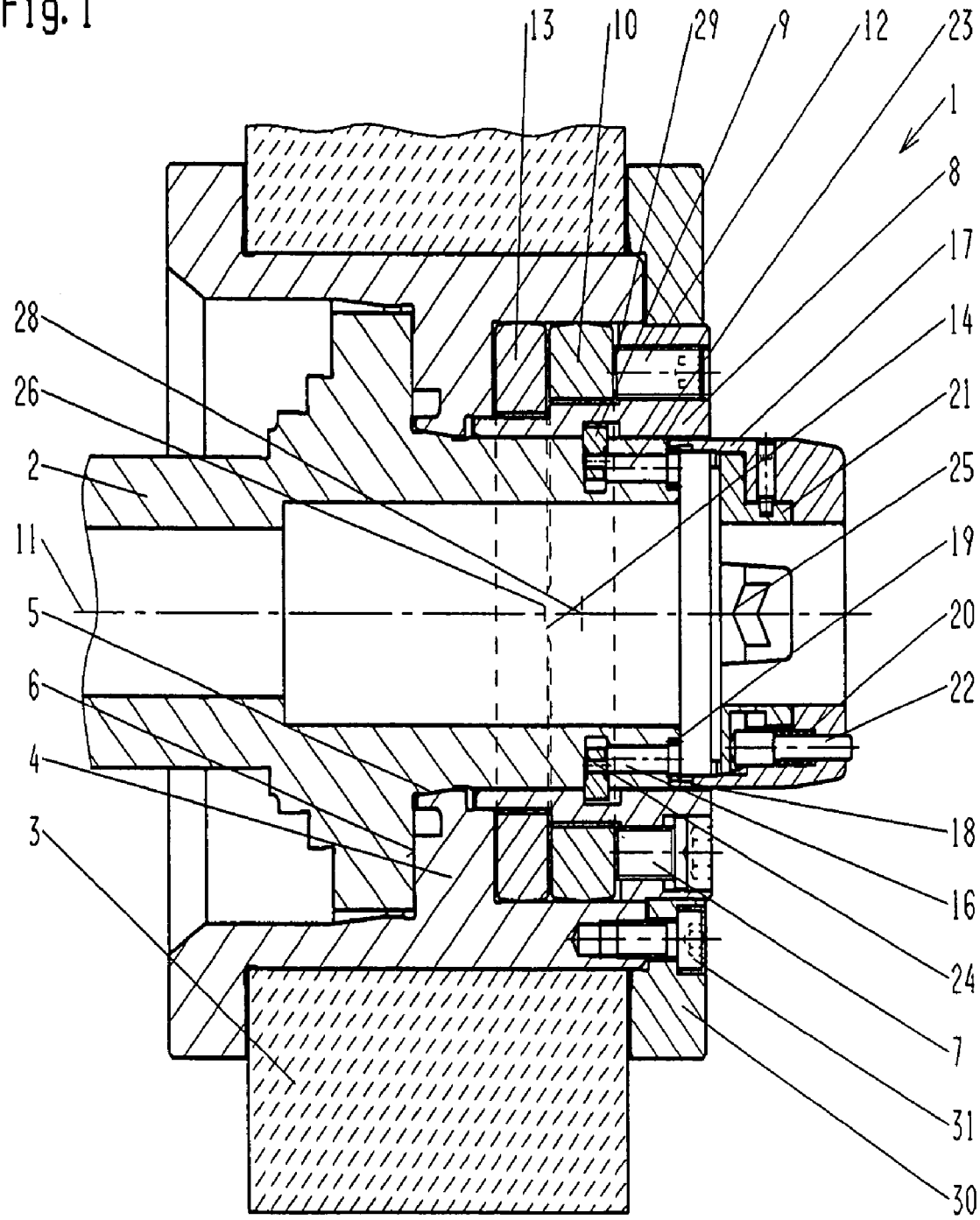
FIG. 1 A diagrammatic representation of a grinding wheel flange on a grinding spindle according to the invention, in axial section.

FIG. 1 depicts a diagrammatic axial section through the grinding wheel flange fixture in the clamped state. A rotary machining tool is composed of a grinding wheel flange 4, on which a grinding wheel 3 is located and by means of a flange cover 30 and at least one, preferably several, fixture screws 31 detachably secured.

The grinding wheel flange 4 is clamped to the spindle nose 1 of the grinding spindle 2. In this state the position of the grinding wheel flange 4 relative to the grinding spindle 2 is governed in the familiar manner by a centring taper 5 of the grinding wheel flange 4 and a grinding spindle flange face 6 against which the grinding wheel flange 4 is brought to bear by means of an axial clamping force.

According to the invention, the clamping force necessary for the fixture of the rotary machining tool is generated by a clamping screw 7 in a flange sleeve 8, which said sleeve is located for axial displacement in the grinding wheel flange 4 and bears axially against bearer segments 9, which themselves are located in the spindle nose 1 and radially swivellable clear of the latter. The clamping screw 7 acts in the axial direction on a first concentric clamping ring 10, which said ring 10 is located for axial displacement in the grinding wheel flange 4 and for tilting about a tilt axis 28 which is at right angles to the grinding spindle axis 11. In the representation shown in FIG. 1 the tilt axis 28 is vertical to the plane of the drawing. The contact of the clamping screw 7 with the first clamping ring 10 defines a first contact point.

The clamping ring 10 furthermore bears axially at a second contact point 29 on a likewise axially adjustable setting screw 12 located in the flange sleeve 8 symmetrically relative to the grinding spindle axis 11. This setting screw 12 serves to adjust the working position of the first clamping ring 10. It is adjusted such that after the clamping of the grinding wheel flange 4 the face of the first clamping ring 10 is approximately at right angles to the grinding spindle axis 11.

Figure 3:
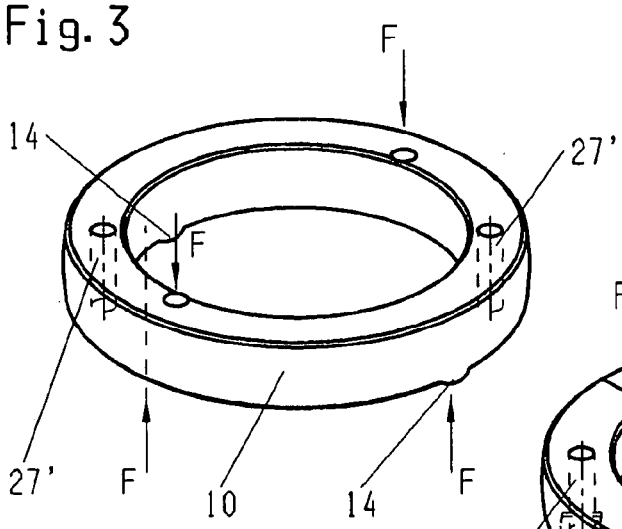
FIG. 3 A perspective representation of a first clamping ring.
Figure 4A:
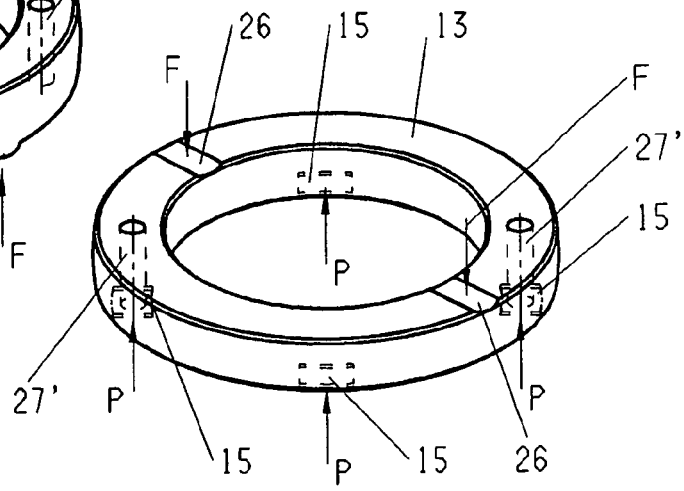
FIG. 4*a* A perspective representation of a second clamping ring.

Located in the grinding wheel flange 4 on the face of the first clamping ring 10 opposite to the clamping screw 7 is a likewise concentric clamping ring 13 which acts as force distributor. This second clamping ring 13 bears axially on two radial cylinder shaped ribs 14 of the first clamping ring 10, which are offset at 90° relative to the clamping screw 7 and the setting screw 12. These ribs 14 are to be seen in FIG. 3. On its face directed towards the first clamping ring 10, the second clamping ring 13 is provided, as is to be seen in FIG. 4*a*, with radial cylinder shaped grooves 26 which serve as bearing seats for the ribs 14 of the first clamping ring 10.

Figure 4B:
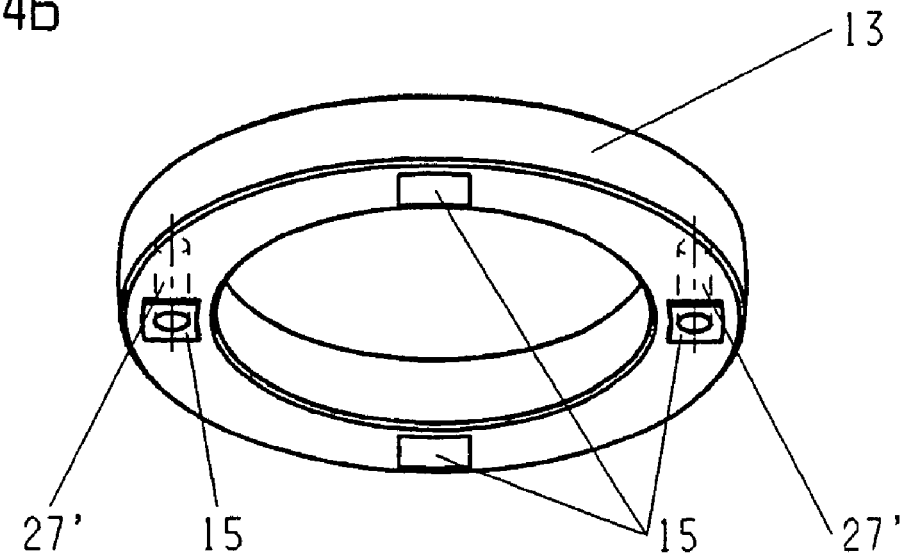
FIG. 4*b* Another perspective representation of the second clamping ring of FIG. 4*a;*

On its face directed away from the first clamping ring 10, the second clamping ring 13 is furthermore provided with four contact surfaces 15 which, symmetric about the grinding spindle axis 11, are each offset at 45° relative to the ribs 14. Via the contact surfaces 15 the second clamping ring 13 presses the grinding wheel flange 4 against the spindle flange 6 with a thrust of P=F/2 per contact surface 15. These contact surfaces are preferably provided in the form of contact lugs protruding from the ring face, as is especially to be seen in FIG. 4*b*.

The arrangement of the clamping rings 10, 13 and the contact points 14, 15 permits a swivelling of the first clamping ring 10 about the connecting line through the contact points of the clamping and setting screws 7, 12 on the one hand, and on the other hand, offset by 90°, about the tilt axis 28. It is thereby achieved that by tightening the clamping screw 7 the flange sleeve 8 and the grinding wheel flange 4 are forced apart, the clamping force F produced by means of the clamping screw 7 thereby being distributed uniformly between the four contact surfaces 15 on the grinding wheel flange 4 symmetrical to the grinding spindle axis 11.

Figure 2:
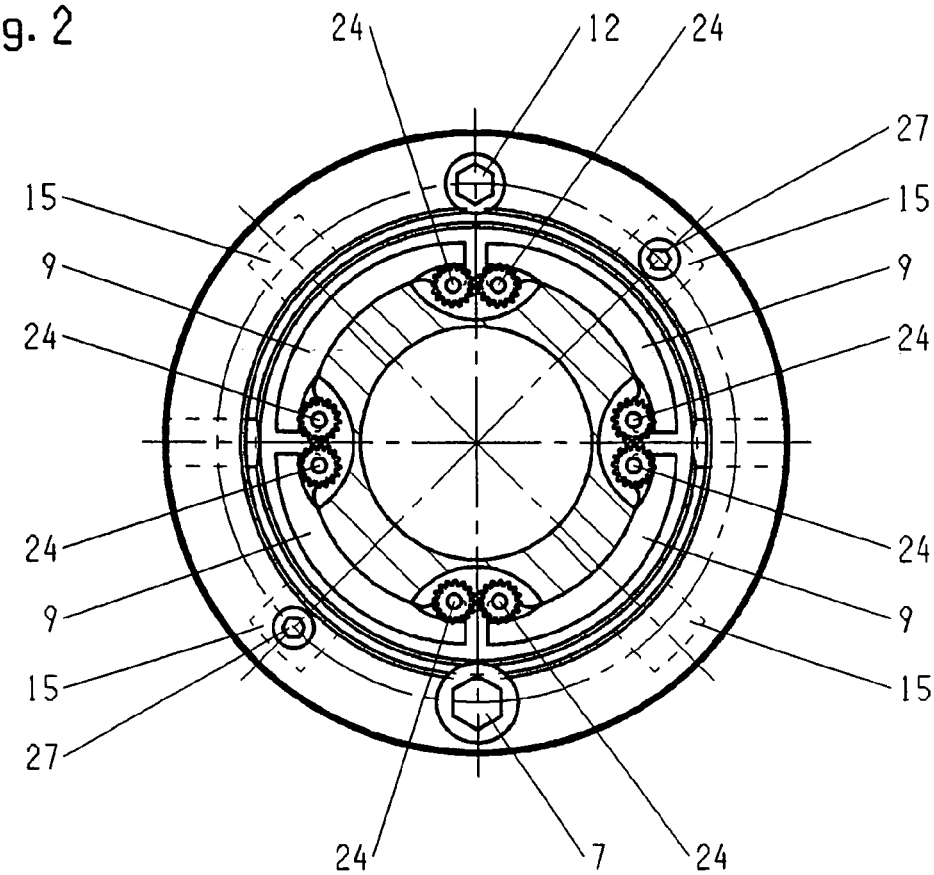
FIG. 2 A diagrammatic representation of the grinding wheel flange of FIG. 1 according to the invention, in cross section.

The flange sleeve 8 is loosely connected to the grinding wheel flange 4 via the stay screws 27. The stay screws 27 pass through corresponding holes 27' in the first and second clamping rings 10, 13. This is seen in the FIGS. 2, 3 and 4*a*. Preferably two stay screws 27 are provided, their being likewise preferably arranged to coincide with two diametrically opposite contact surfaces 15.

For a tool change the clamping screw 7 is loosened and the bearer segments 9 swivelled in. Then the grinding wheel flange 4, together with the flange sleeve 8 connected to the former via the stay screws 27, is pulled off the spindle nose 1. Subsequently the grinding wheel flange of a fresh grinding wheel to be fitted, including the appropriate flange sleeve 8 and clamping rings 10, 13, is pushed onto the grinding spindle nose 1. Then the bearer segments 9 are swivelled out and the clamping screw 7 tightened again. The tool change is thus completed.

Figure 5:
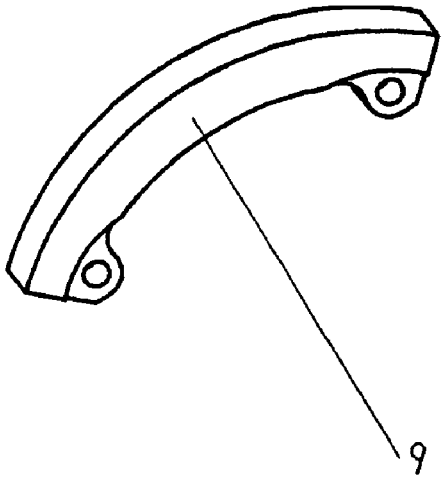
FIG. 5 A perspective representation of a bearer segment.
Figure 6:
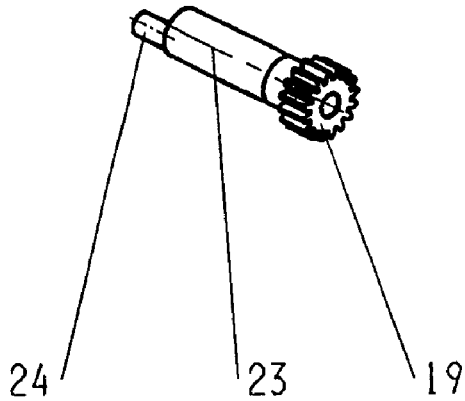
FIG. 6 A perspective representation of an eccentric stud.

Hence for the fitting of the grinding wheel flange 4 no loose components such as screws or nuts are required. The swivelling in and out of the bearer segments 9 takes place in a simple manner. To this purpose, as is to be seen in FIG. 1, the bearer segments 9 are swivellably located in the grinding spindle nose 1 by means of two eccentric studs 16 each. These eccentric studs 16 can be rotated synchronously by means of an adjusting cap 17 located for rotation on the grinding spindle nose, the internal teeth 18 of the cap 17 engaging with the teeth 19 of the eccentric studs 16, so that the bearer segments 9 can be brought to the desired radial position. This is also to be seen in FIG. 2. FIG. 5 depicts a bearer segment 9. FIG. 6 depicts an eccentric stud axis 23 with teeth 19 and eccentric stub 24.

The prevailing radial position of the bearer segments 9 is made visible by the axial position of a monitor pin 22 which is located for axial displacement in the adjusting cap and pre-tensioned by means of a spring 20 against a cam ring 21. The cam ring 21 is connected rigidly to the spindle nose.

In the angular position of the adjusting cap 17 in which the bearer segments 9 are in the swivelled out position, the cam ring 21 is provided with a recess 25 in the direction of motion of the monitor pin 22, by which means it is achieved that in this swivel position the monitor pin 22 no longer protrudes from the adjusting cap 17. This allows the proper clamping of the grinding wheel flange 4 to be checked visually and with electronically operating sensors.

Other embodiments are possible. Instead of the four contact surfaces 15 described above, for example, three or more contact surfaces can be used.

Preferably the flange sleeve 8 and the first and second clamping rings 10, 13 are component parts of the rotary tool or its tool holder, and are exchanged together with the latter as described here.

Instead of a grinding wheel, other kinds of rotary machining tools can be attached in the same manner.

List of reference numbers

| | |
|---|---|
| 1 | Grinding spindle nose |
| 2 | Grinding spindle |
| 3 | Grinding wheel |
| 4 | Grinding wheel flange |
| 5 | Centring taper |
| 6 | Grinding spindle flange face |
| 7 | Clamping screw |
| 8 | Flange sleeve |
| 9 | Bearer segment |
| 10 | Fist clamping ring |
| 11 | Grinding spindle axis |
| 12 | Setting screw |
| 13 | Second clamping ring |
| 14 | Rib |
| 15 | Contact surface |
| 16 | Eccentric stud |
| 17 | Adjusting cap |
| 18 | Internal teeth |
| 19 | Teeth |
| 20 | Spring |
| 21 | Cam ring |
| 22 | Montior pin |
| 23 | Eccentric stud axis |
| 24 | Eccentric stub |
| 25 | Recess |
| 26 | Groove |
| 27 | Stay screw |
| 28 | Tilt axis |

-continued

| List of reference numbers |
|---|
| 29 Contact point |
| 30 Flange cover |
| 31 Fixture screw |
| F Clamping force |
| P Contact thrust |

The invention claimed is:

1. Device for the fixture of a tool holder of a rotary machining tool to the spindle nose of a tool spindle of a machine tool, the tool holder being provided with a fixture flange, wherein the device comprises a flange sleeve, an axially displaceable and tiltable first clamping ring, a second clamping ring acting as force distributor, and swivel-clear bearer segments, where the first and second clamping rings are arranged between the fixture flange and the flange sleeve, where the first clamping ring is located for tilting on the second clamping ring by means of a clamping screw, and where the bearer segments support the flange sleeve axially on the spindle nose.

2. Device according to claim 1, wherein the clamping screw engages in the flange sleeve and furthermore a setting screw symmetrically opposite to the clamping screw about the grinding spindle axis engages in the flange sleeve.

3. Device according to claim 1, wherein the first clamping ring is located in the fixture flange coaxial to the spindle axis and bears on the clamping screw and the setting screw, where the first clamping ring is provided with radial cylinder shaped ribs on its face opposite to the clamping screw and the setting screw, the said ribs being offset by 90° relative to the clamping screw and the setting screw.

4. Device according to claim 1, wherein the second clamping ring is located in the fixture flange coaxial to the spindle axis and is provided with grooves, by which grooves it is supported on the ribs of the first clamping ring, and where the face of the second clamping ring opposite to the first clamping ring is provided with contact surfaces.

5. Device according to claim 4, where the second clamping ring is provided with four such contact surfaces which are arranged symmetrically about the axis, and which are each offset by 45° relative to the ribs of the first clamping ring.

6. Device according to claim 1, wherein at least three of these bearer segments are provided, their being located symmetrically about the spindle axis and being swivellable in and out radially.

7. Device according to claim 1, where the bearer segments are located in the spindle nose.

8. Device according to claim 1, wherein the device is provided with eccentric studs which are located for rotation about axes parallel to the tool spindle axis, and which are provided with eccentric stubs for rotational connection with the bearer segments, and the shank ends of which are provided with teeth.

9. Device according to claim 8, the eccentric pins being located in the spindle nose.

10. Device according to claim 8, wherein by means of turning an adjustable cap located on the spindle nose for rotation about the grinding spindle axis the eccentric studs can be rotated via the inside teeth of the said cap which engage with the teeth of the eccentric studs.

11. Device according to claim 10, wherein the adjusting cap is provided with a monitor pin located in the said cap for axial displacement parallel to the spindle axis, which said pin is pre-tensioned via a spring against a cam ring connected rigidly with the spindle nose.

12. Device according to claim 11, wherein in that angular zone of the adjusting cap in which the bearer segments are not swivelled out, the cam ring is provided with an elevation which allows the monitor pin to protrude from the adjusting cap.

* * * * *